US005192184A

United States Patent [19]

Nobuo et al.

[11] Patent Number: 5,192,184

[45] Date of Patent: Mar. 9, 1993

[54] FUEL FEED PUMP

[75] Inventors: Yamada Nobuo, Kiryu; Keiji Kiuchi, Yabuzuka-honmachi, both of Japan

[73] Assignee: Mitsuba Electric Manufacturing Co., Ltd., Gunma, Japan

[21] Appl. No.: 893,608

[22] Filed: Jun. 3, 1992

Related U.S. Application Data

[63] Continuation of Ser. No. 717,925, Jun. 20, 1991, abandoned.

[30] Foreign Application Priority Data

Jun. 22, 1990 [JP] Japan ..... 2-164770
Jun. 29, 1990 [JP] Japan ..... 2-69052[U]

[51] Int. Cl.[5] ..... F04D 5/00
[52] U.S. Cl. ..... 415/169.1; 415/55.1
[58] Field of Search ..... 415/169.1, 55.1, 55.2, 415/55.3, 55.4, 55.5, 55.6

[56] References Cited

U.S. PATENT DOCUMENTS 4,538,958 9/1985 Takei et al. ..... 415/55.5
4,793,766 12/1988 Kumata ..... 415/55.1
5,009,575 4/1991 Hanai et al. ..... 415/55.5

FOREIGN PATENT DOCUMENTS 18497 1/1982 Japan ..... 415/55.4
138297 7/1985 Japan ..... 415/55.3
401828 3/1974 U.S.S.R. ..... 415/55.4
436175 12/1974 U.S.S.R. ..... 415/55.4
2068461 8/1981 United Kingdom ..... 415/55.4

*Primary Examiner*—John T. Kwon
*Attorney, Agent, or Firm*—McGlew and Tuttle

[57] ABSTRACT

A fuel feed pump for a motor vehicle, wherein a liquid sealing portion is formed in a position close to an impeller in a casing, an exhaust port is opened in the intermediate portion of the liquid sealing portion in a manner to communicate the inner space of the liquid sealing portion with the outside of the casing. The casing is opened therein with a deairing hole for communicating the liquid sealing portion with the outside of the casing. A deairing groove is formed at least on the upper end surface of the casing. One end of the deairing groove is communicated with the upper space of a generally annular groove path and the other end is communicated with the deairing hole, traversing the liquid seal portion.

5 Claims, 6 Drawing Sheets

FUEL FEED PUMP

This is a file wrapper continuation of application Ser. No. 07/717,925 filed Jun. 20, 1991 now abandoned.

BACKGROUND OF THE INVENTION

1. Field of the Invention

This invention relates to a fuel feed pump, and more particularly to a fuel feed pump of a frictional pump type, e.g. one effectively used for an electronically controlled fuel injection device.

2. Related Art Statement

Since a frictional pump used in a fuel feed pump has no self-priming properties in general, as the vapor quantity in a casing increases, discharge quantity decreases, thus resulting in a vapor lock.

Therefore, it has been the common practice that, in the conventional fuel feed pump of this type, deairing holes are opened in a generally annular groove path formed in an annular zone between an intake port and a discharge port except a liquid sealing portion in a casing, whereby vapor is deaired through the deairing holes when the fuel is separated from the vapor by the centrifugal force.

The reason why the deairing holes have heretofore been downwardly opened resides in that, in order to wash and cool a commutator and brushes in a motor portion provided in the upper portion of the fuel feed pump, the interior of a housing of the motor portion is made to serve as a fuel path, whereby the interior of the housing of the motor portion is highly pressurized, therefore the vapor cannot be deaired through the deairing holes, so that the deairing holes are opened downwardly in order that the vapor does not intrude into the interior of the housing where the motor portion is disposed.

However, recently, the number of component parts housed in an engine spaces of a motor vehicle has greatly increased, whereby, with the fuel feed pump in which only the downwardly opened deairing holes are formed in the intermediate portion of the groove path, the deairing effect has become insufficient.

Namely, as the number of the component parts in the engine space of the motor vehicle is increased highly, the temperature in the engine space tends to be raised. In an electronically controlled fuel injection device, a part of the fuel constantly circulates through the engine space and returns to a fuel tank, whereby the temperature of the fuel in the tank tends to further easily increase. As the temperature of the fuel is raised, boiling of the fuel itself and agitation of the fuel by the fuel feed pump produce a large quantity of vapor. When the large quantity of vapor is produced, the arrangement in which only the deairing holes are opened in the intermediate portion of the groove path can not deair the vapor sufficiently. Particularly, the vapor is lower in gravity than the fuel, whereby the vapor tends to accumulate in the upper space of the groove path, so that, in the conventional fuel feed pump in which the deairing holes are opened downwardly, the vapor cannot be deaired sufficiently.

Then, even if it is tried to deair the vapor into the interior of the motor portion from the upper space of the groove path, the vapor cannot be discharged upwardly because the vapor discharged from the deairing holes is lower in pressure than the highly pressurized fuel passing through the interior of the motor portion.

Further, when the highly pressurized fuel and the vapor which has not been deaired return to the intake side, the pressure is abruptly lowered, whereby intake of the fuel through the intake port is disturbed by the new production of the vapor and the expansion of the vapor, so that the vapor lock tends to occur.

SUMMARY OF THE INVENTION

An object of the present invention is to provide a fuel feed pump, wherein the quantity of vapor produced in the vicinity of an intake port is reduced, and, even when the large quantity of vapor is produced, vapor can be deaired sufficiently.

Another object of the present invention is to provide a fuel feed pump wherein vapor produced in the upper portion of a groove path is discharged to the outside of a casing, and returns of the remaining vapor which has not been deaired through deairing holes and a part of the highly pressurized fuel are discharged through an exhaust hole formed in a sealing portion so as to suppress the production of vapor itself and to sufficiently deair vapor even when the large quantity of vapor is produced.

The fuel feed pump according to the present invention is characterized in that, in a fuel feed pump comprising: a casing immersed in a fuel tank for a motor vehicle; an impeller rotatably installed in the casing and provided on the outer periphery thereof with a plurality of grooves; a liquid sealing portion formed in a position close to the impeller on rotating loci of a group of the grooves of the impeler in the casing; an intake port and a discharge port respectively opened in positions interposing the liquid sealing portion in the circumferential direction in the casing; and a generally annular groove path formed between the intake port and the discharge port in a zone excluding the liquid sealing portion of the casing; an exhaust port is opened in the intermediate portion of the liquid sealing portion in a manner to be communicated with an inner space of this liquid sealing portion and this exhaust port is communicated with the outside of the casing.

Furthermore, the groove path is formed with deairing holes for communicating the interior of the groove path with the outside of a housing.

In the fuel feed pump according to the present invention, the exhaust port is opened in the liquid sealing portion, whereby the fuel is reduced in pressure here, so that new production of the vapor can be suppressed. Furthermore, the remaining vapor which has not been discharged through the deairing holes can be deaired through this exhaust port. Accordingly, the quantity of the vapor produced in the vicinity of the intake port is decreased, so that a vapor lock can be avoided.

Furthermore, another fuel feed pump according to the invention is characterized in that the deairing holes are opened in the casing in a manner to communicate the liquid sealing portion with the outside of the casing, and a deairing groove is formed at least in the upper end surface of this casing in such a manner that one end thereof is communicated with the upper space of the groove path and the other end thereof is communicated with the deairing holes, passing through the liquid sealing portion.

In the above-described fuel feed pump of another type according to the present invention, the deairing groove is communicated with the upper space of the groove path, so that the vapor which tends to accumulate in the upper space of the groove path can be very effectively deaired from the groove path by this deairing groove. Accordingly, the quantity of the vapor reaching the vicinity of the intake port is decreased and the intake port is constantly filled up with the fuel, so that the vapor lock can be avoided.

Furthermore, the deairing groove traverses the liquid sealing portion, whereby the pressure in the liquid sealing portion is reduced, so that the occurrence of a vapor lock can be further prevented.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENTS

Embodiment 1

Figure 1:
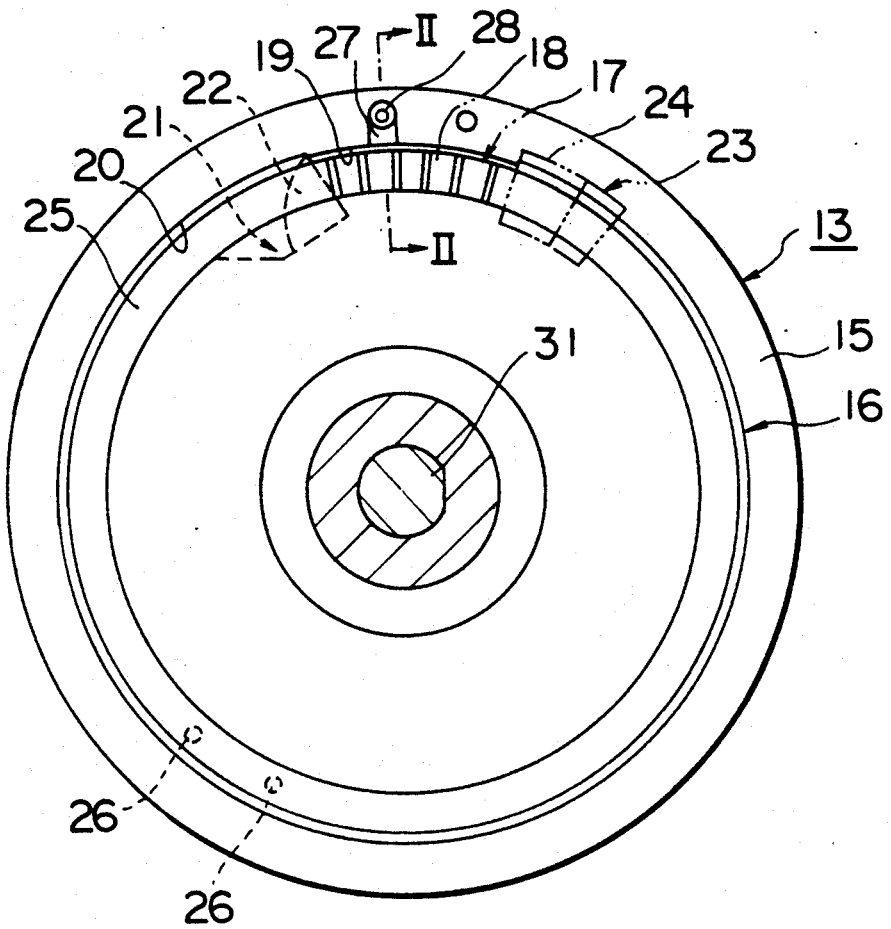
FIG. 1 is a partially omitted plan sectional view taken along the line I—I in FIG. 3 showing an embodiment of the fuel feed pump according to the present invention.
Figure 2:
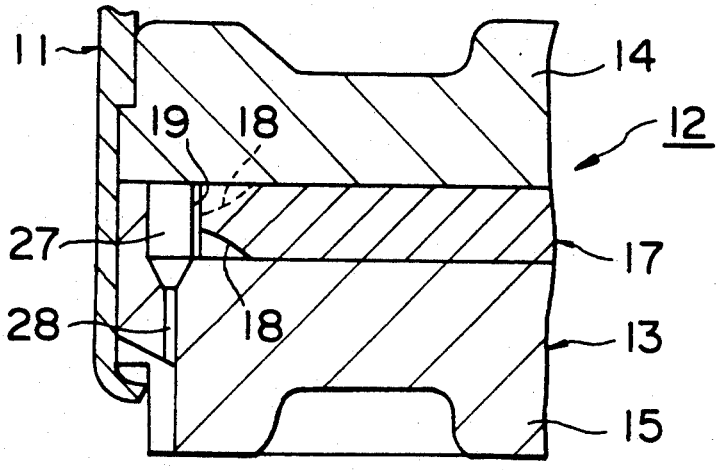
FIG. 2 is an enlarged partially sectional view taken along the line II—II in FIG. 1.
Figure 3:
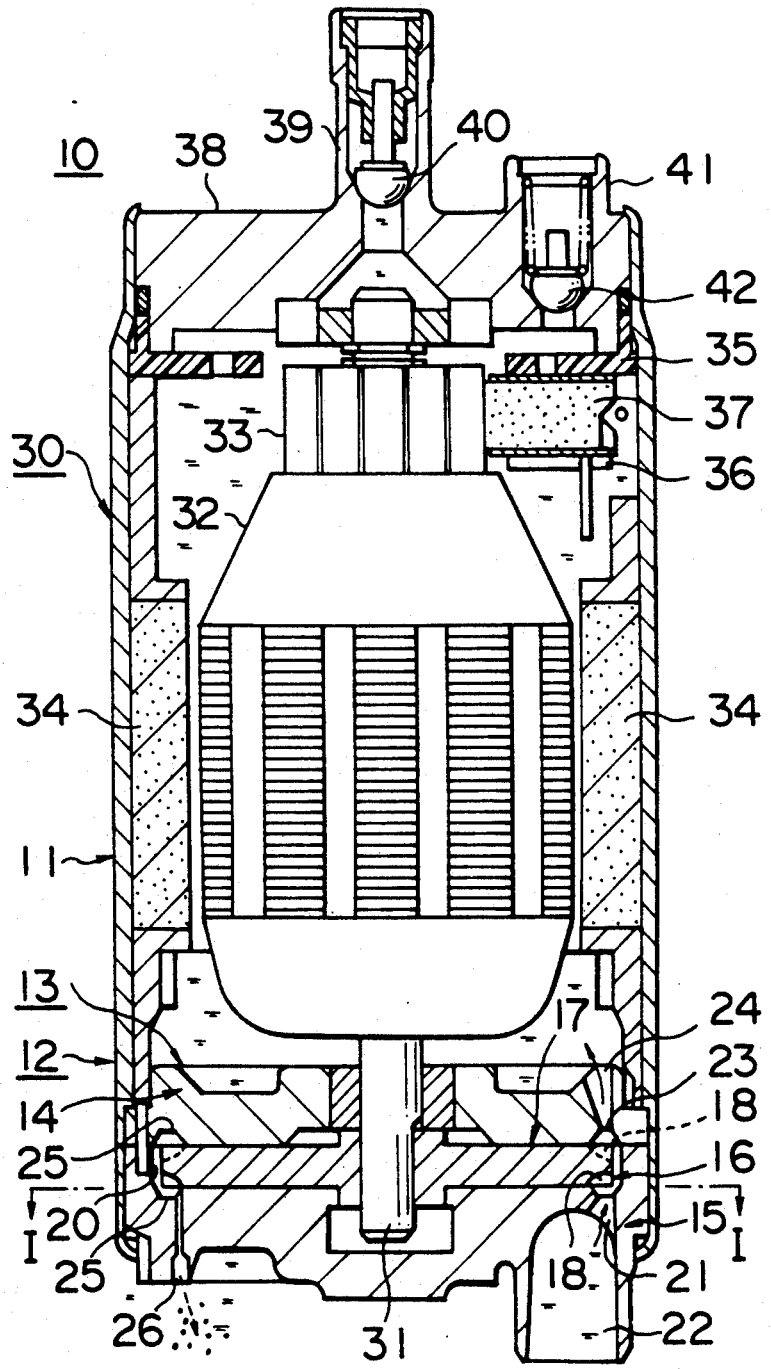
FIG. 3 is a front sectional view showing an embodiment of the fuel feed pump according to the present invention.

Referring to the drawings, in this Embodiment 1 shown in FIG. 1 through 4, a fuel feed pump according to the present invention 10 has a pump portion 12 and a motor portion 30, both portions being installed in a housing 11. This fuel feed pump 10 is wholely immersed in a fuel tank, not shown, with the pump portion disposed below. A casing 13 of the pump portion 12 is fixedly incorporated in the bottom end portion of the housing 11. The casing 13 has a pump plate 14 and a pump head 15, both of which are assembled into the housing 11 with the both members disposed back to back. A generally disk-shaped hollow pump chamber 16 is defined by surfaces of the pump plate 14 and the pump head 15 which face each other. The pump chamber 16 incorporates therein a disk-shaped impeller 17 rotatably and coaxially therewith. A plurality of generally quater round-shaped grooves 18 being inwardly directed are disposed at equal intervals in the circumferential direction at opposite sides of the outer periphery of the impeller 17. Rotation of the impeller 17 makes this group of grooves 18 move in the circumferential direction in a space formed on the outer periphery of the pump chamber 16. A motor shaft 31 to be described hereunder is inserted into the central axis of the impeller 17, whereby the impeller 17 is rotatably driven by the motor shaft 31.

A liquid sealing portion 19 is formed in a position very close to the outer peripheral surface of the impeller 17 on the inner periphery of an erected wall of the pump head 15, with the erected wall defining the inner peripheral surface of the pump chamber 16 in the casing 13. And relatively, a gap portion 20 having suitable dimensions is formed on the inner periphery excluding the liquid sealing portion 19. Furthermore, the pump head 15 is provided with an intake port 21 which is disposed at the initial end in the rotating direction out of the opposite sides in the circumferential direction of the liquid sealing portion 19 and communicates with the pump chamber 16. The intake port 21 communicates with the outside of the housing 11 through an intake hole 22 opened in the pump head 15.

On the other hand, the pump plate 14 is provided with a discharge port 23 disposed on the side opposite to the intake port 21 of the liquid sealing portion 19 and communicates with the interior of the pump chamber 16. The discharge port 23 is communicates with the interior of the housing 11 through a discharge hole 24 opened in the pump plate 14.

Generally annular groove paths 25 are recessedly formed extending from the intake port 21 and the discharge port 23 respectively on the outer periphery portions of end surfaces of the pump chamber 16 in the casing 13, both outer periphery portions of end surfaces of the pump chamber 16 being defined by the outer periphery portions of end surfaces of the pump plate 14 and the pump head 15. Two deairing holes 26 are disposed at generally central portions of the circumferential length of the groove paths 25, the interiors of the groove paths 25 communicate with the outside of the housing 11.

In this Embodiment 1, the pump head 15 is provided with an exhaust port 27, which is disposed in the intermediate portion of the liquid sealing portion 19, facing the outer peripheral surface of the impeller 17 and communicating with the interior of the pump chamber 16. This exhaust port 27 communicates with the outside of the housing 11 through an exhaust hole 28 opened in the pump head 15.

On the other hand, in the motor portion 30, the motor shaft 31 having fixed thereto the impeller 17, is disposed in the central axis of the housing 11 and is rotatably supported. An armature 32 and a commutator 33 are fixedly mounted to the motor shaft 31. A plurality of magnets 34 are fixedly provided on the inner peripheral surface of the housing 11 at equal intervals in a circumferential direction thereof and opposed to the armature 32. A brush holder stay 35 is fixedly mounted to the top end portion in the housing in such a manner that brush holders 36 mounted thereto are opposed to the commutator 33. Brushes 37 housed in the brush holders 36 are in sliding contact with the commutator 33. An end bracket 38 is coupled and fixed to the top end portion of the housing 11. A discharge pipe path 39 in communication with a fuel injection device, not shown, is integrally projected from the end bracket 38 in a manner to be disposed at the central portion and in communication with the interior of the housing 11. The discharge pipe path 39 incorporates therein a check valve 40. A relief valve 41 is integrally projected from the end bracket 38 in a manner to be disposed at a portion of the outer periphery of the end bracket 38 and provides communication between the interior and the exterior of the housing 11. The relief valve 41 incorporates therein a depressurization valve 42.

Action of this Embodiment 1 will hereunder be described.

Rotation of the motor shaft 31 in the motor portion 30 makes the impeller 17, fixedly mounted thereto, be rotatably driven. When the impeller 17 rotates, the fuel is taken into the group of the grooves 18 formed on the outer periphery of the impeller 17 through the intake port 21 and discharged from the discharge port 23. The fuel discharge from the discharge port 23 is discharged into the interior of the housing 11 through the discharge hole 24, and delivered to the fuel injection device, not shown, through a discharge pipe path 39.

During this pump operation, the vapor produced in the groove paths 25 is deaired to the outside of the housing 11 through the deairing holes 26 opened in the intermediate portions of the groove paths 25.

Furthermore, the exhaust port 27 is opened in the liquid sealing portion 19 in this Embodiment 1, whereby the vapor which has not been deaired through the deairing holes 26 opened in the intermediate portions of the groove paths 25 is passed through the exhaust port 27 and the exhaust hole 28 and exhausted to the outside of the housing 11. At this time, pressure is reduced in the exhaust port 27 of the liquid sealing portion 19, whereby the vapor is exhausted effectively, so that the vapor can be prevented from being produced in the vicinity of the intake port 21 after passing the exhaust port 27. As the result, the intake port 21 is constantly filled up with a fuel, so that the vapor lock can be prevented from occurring.

Figure 4:
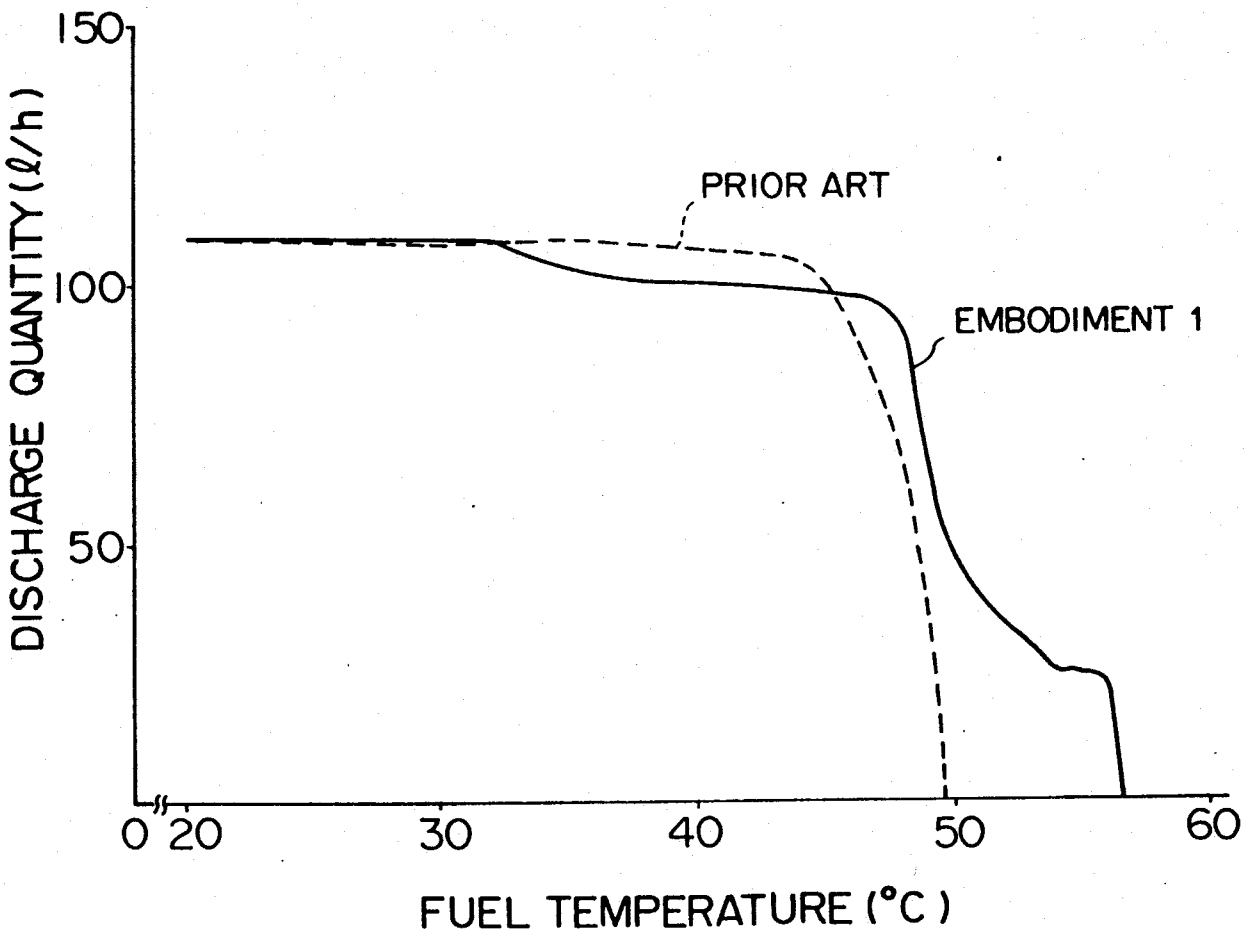
FIG. 4 is a comparative graphic chart for explaining the actions.

FIG. 4 is the comparative graphic chart showing the decrease of the discharge quantity of the fuel feed pump with the rise in the temperature of the fuel, wherein a solid curve shows the case of this Embodiment 1 and a broken curve shows the conventional example.

As shown in FIG. 4, in the case of this Embodiment 1 as compared with the conventional example, the temperature at which the discharge quantity of the pump is decreased and the temperature at which the vapor lock is caused are both raised, so that the decrease of the discharge quantity of the pump relative to the temperature of the fuel can be improved.

As described above, in the above Embodiment 1 of the present invention, the exhaust port is opened in the liquid sealing portion, so that the vapor can be exhausted effectively and the vapor lock can be prevented from occurring.

Embodiment 2

Figure 5:
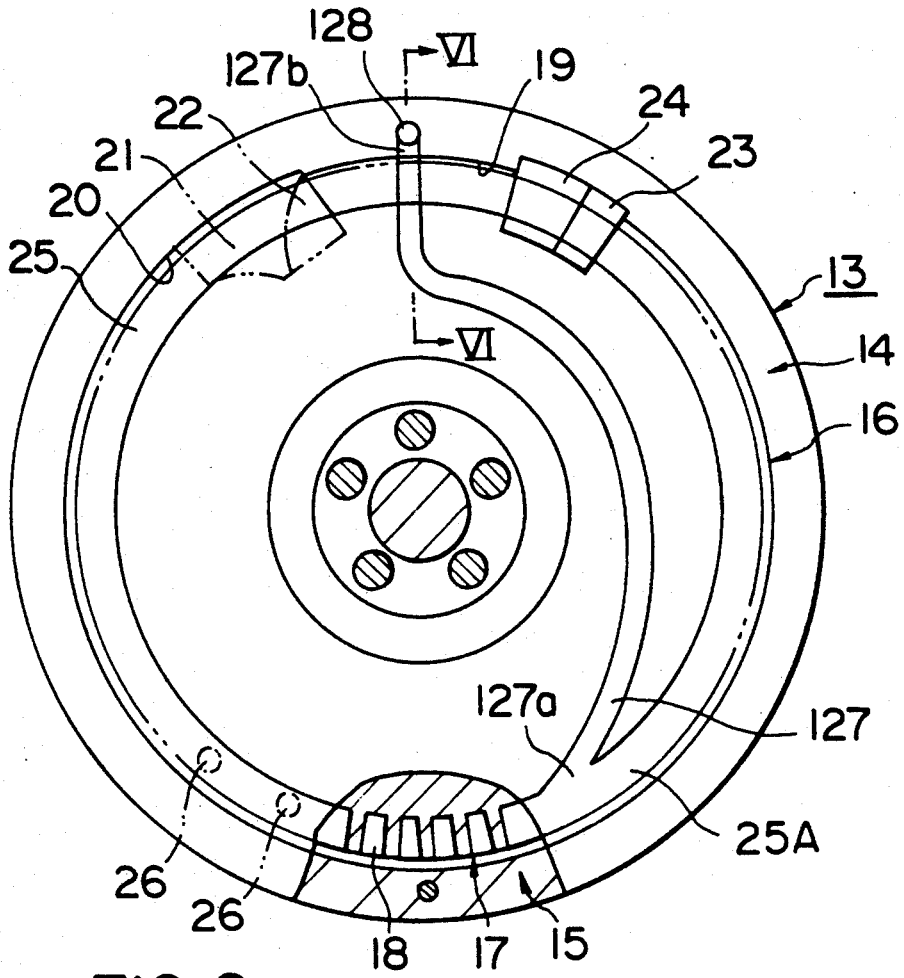
FIG. 5 is a partially omitted plan sectional view showing another embodiment of the fuel feed pump according to the invention, taken along the line V—V in FIG. 7.
Figure 6:
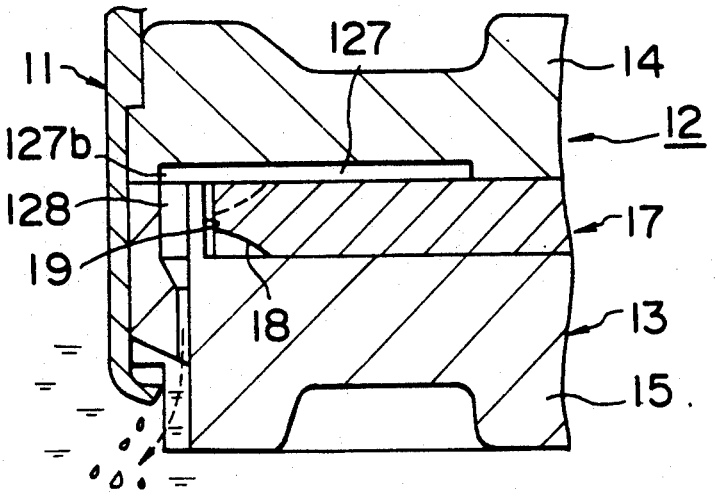
FIG. 6 is an enlarged partially sectional view taken along the line VI—VI in FIG. 5.
Figure 7:
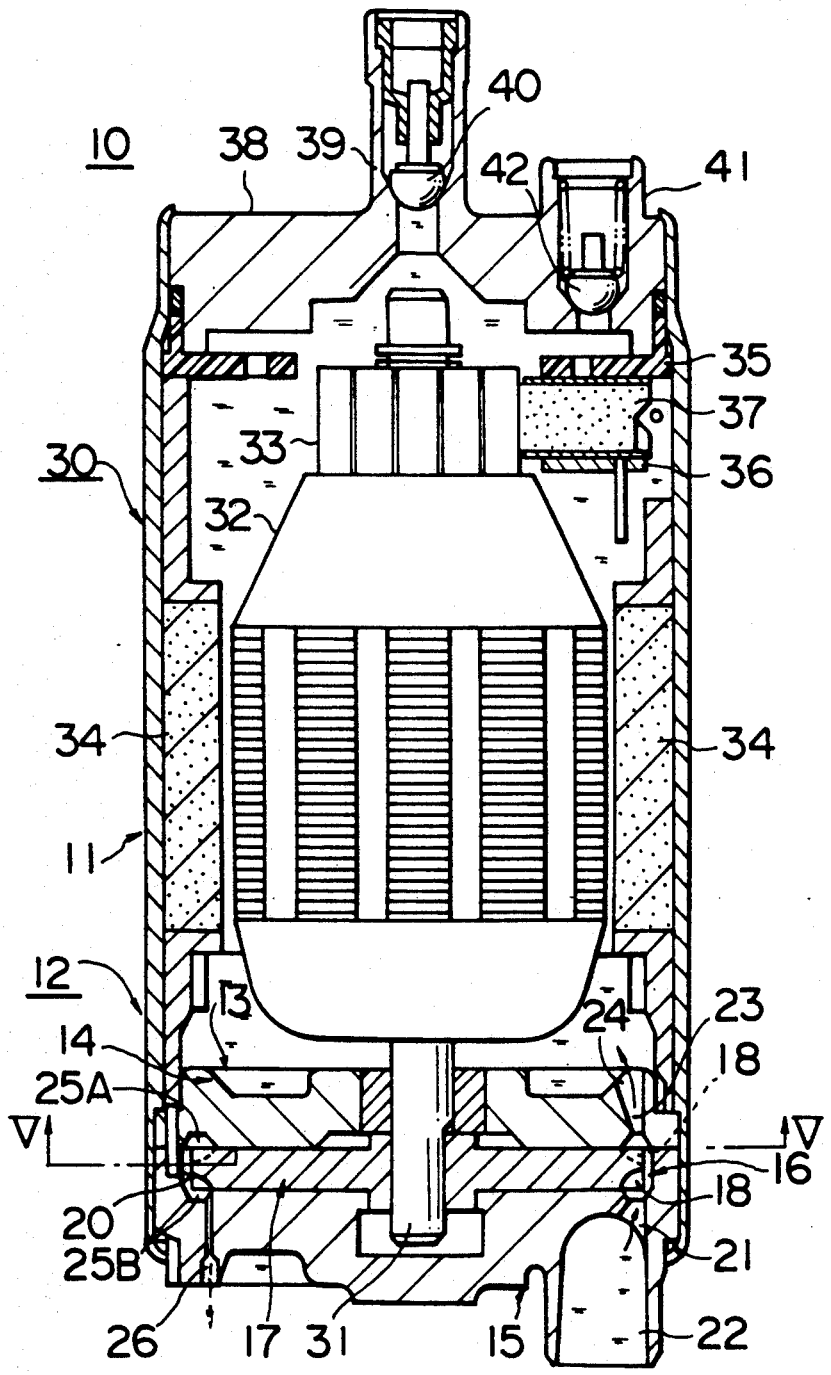
FIG. 7 is a front sectional view showing the fuel feed pump thereof.

The second embodiment of the present invention as shown in FIGS. 5 through 7 will hereunder be described.

Almost all of the construction of this Embodiment 2 is similar to that in the above Embodiment 1.

In this Embodiment 2, an upper groove path 25A and a lower groove path 25B are resessedly provided in generally annular shapes from the intake port 21 to the discharge port 23 respectively on the outer periphery portions of the end surfaces of the pump plate 14 and the pump head 15, both of which define the upper and lower outer periphery portions of the end surfaces of the pump chamber 16 in the casing 13. A plurality of downwardly directed deairing holes 26 are disposed in the generally central portion of the circumferential length of the lower groove path 25B and opened downwardly in a manner to provide communication between the interior of the lower groove path 25B with the outside of the housing 11. Furthermore, in this Embodiment 2, a deairing groove 127 is recessedly provided in a generally circularly arcuate shape on the inner surface of the pump plate 14 which is opposed to the upper surface of the impeller 17, the initial end portion 127*a* of this deairing groove 127 is in communication with the generally central portion of the circumferential length of the upper groove 25A, and the tail end thereof traverses the liquid sealing portion 19 and is in communication with the inner end portion of a deairing hole 128 to be described hereunder.

In this Embodiment 2, the deairing hole 128 is disposed in the vicinity of the generally central portion of the liquid sealing portion in the casing 13, opened in a manner to be in communication with the outside of the housing 11 from the pump plate 14 to the pump head 15, and the tail end of the deairing groove 127 traverses the liquid sealing portion 19 and is fluidally connected to the inner end portion of this deairing hole 128 on the side of the pump plate 14.

Action of the Embodiment 2 will hereunder be described.

Rotation of the motor shaft 31 in the motor portion makes the impeller 17 fixedly mounted thereto be rotatably driven. When the impeller 17 rotates, the fuel is taken into the group of grooves 18 formed on the outer periphery of the impeller 17 through the intake port 21, and discharged from the discharge port 23 by the centrifugal force. The fuel discharged from the discharge port 23 is discharged into the interior of the housing 11 through the discharge hole 24, and passes through the discharge pipe path 39 and is delivered to the fuel injection device, not shown.

During this pump operation, the vapor produced in the upper groove path 25A is taken into the deairing groove 127 opened in the intermediate portion of the upper groove path 25A, delivered into the deairing hole 128, and then, deaired to the outside of the housing 11. Furthermore, the vapor produced in the lower groove path 25B is directly deaired to the outside of the housing 11 through the downwardly directed deairing holes 26 opened in the intermediate portion of the lower groove path 25B.

Now, the vapor is lower in gravity than the fuel, whereby the vapor tends to accumulate in the upper groove paths 25A out of the both upper and lower groove paths 25A and 25B. Then, in this Embodiment 2, the deairing groove 127 is opened to be in communication with the interior of the upper groove path 25A, so that the vapor accumulated in the upper groove path 25A can be very effectively deaired from the groove path, i.e. the pump chamber 16. Accordingly, the vapor is prevented from being produced in the vicinity of the intake port 21 after the vapor has passed the discharge port 23. As the result, the intake port 21 is constantly filled up with a fuel, so that the vapor lock can be prevented from occurring.

Furthermre, the deairing groove 127 traverses the liquid sealing portion 19, whereby pressure in the liquid sealing portion is reduced and production of the vapor due to the pressure reduction is eliminated, so that the vapor lock can be further prevented from occurring.

Embodiment 3

A further embodiment of the present invention wili hereunder be described with reference to FIGS. 8 and 9.

Figure 8:
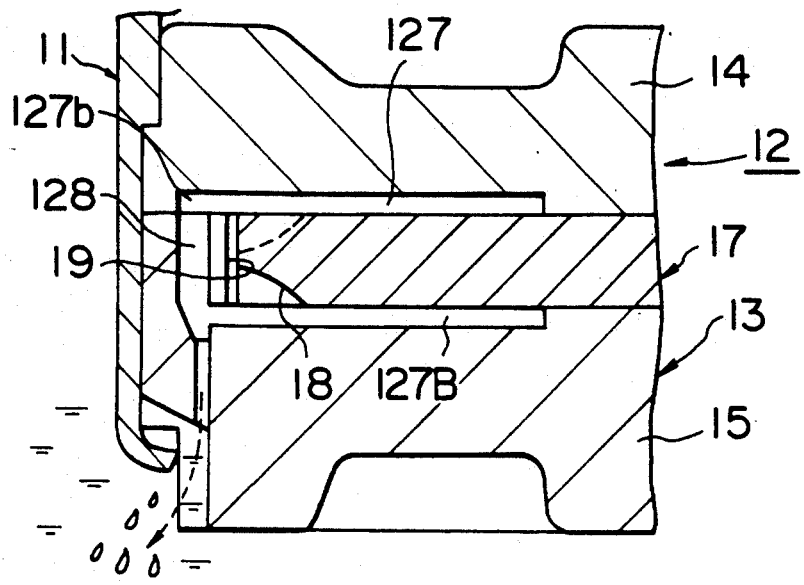
FIG. 8 is an enlarged partially sectional view showing a further embodiment of the present invention, corresponding to FIG. 7.

FIG. 8 is the enlarged partially sectional view showing the Embodiment 3 of the present invention, corresponding to FIG. 7.

The difference of this Embodiment 3 from the above Embodiment 2 resides in that the deairing groove 127B is also provided on the side of the pump head 15 and the tail end of this deairing groove 127B is connected to the deairing hole 128. In this Embodiment 3, the downwardly directed deairing holes 26 are omitted.

Figure 9:
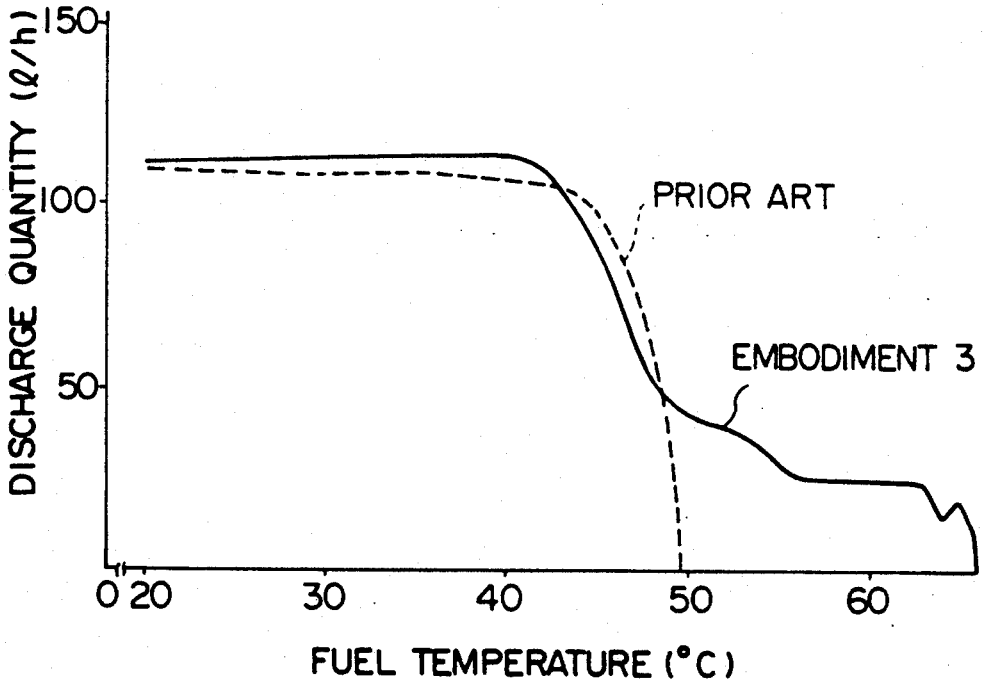
FIG. 9 is a comparative graphic chart explaining the actions.

FIG. 9 is the comparative graphic chart showing the decrease of the discharge quantity of the fuel feed pump with the rise of the temperature of the fuel, wherein the solid curve shows the case of this Embodiment 3 and the broken curve shows the case of the conventional example.

As shown in FIG.9, in the case of this Embodiment 3 as compared with the conventional example, the temperature at which the discharge quantity of the pump is decreased and the temperature at which the vapor lock is caused are raised, so that the discharge quantity of the pump relative to the temperature can be improved.

As has been described hereinabove, according to the present invention, the vapor can be exhausted effectively and the vapor lock can be prevented from occurring.

The present invention should not be limited to the above embodiments, various modifications may be adopted, and these modifications should be included within the scope of the present invention.

What is claimed is:

1. A fuel feed pump comprising:

a casing immersed in a fuel tank for a motor vehicle, said casing comprising a pump head and a pump plate;

an impeller rotatably installed in the casing and provided on the outer peripheries thereof with a plurality of grooves;

a liquid sealing portion formed in a position close to the impeller rotating loci of a group of the grooves of the impeller in the casing;

an intake port and a discharge port respectively opened in positions interposing the liquid sealing portion in the circumferential direction in the casing, the intake port being provided in the pump head and the discharge port in the pump plate;

a generally annular groove path formed between the intake port and the discharge port in a zone excluding the liquid sealing portion of the casing;

a deairing hole disposed in said groove path in the pump head; and an exhaust port formed having a length substantially equal to said impeller's thickness and opened in the intermediate portion of the liquid sealing portion in a manner to communicate with an inner space of the liquid sealing portion and with the outside of the casing through said pump head to environmental pressure whereby said exhaust port is at a pressure level of the outside of the casing said pressure level being lower than a discharge pressure at said discharge port.

2. The fuel feed pump as set forth in claim 1, wherein:

said groove path is formed with deairing holes providing communication between the interior of said groove path and the outside of a housing.

3. The fuel feed pump as set forth in claim 1, wherein:

deairing holes are opened in said casing in a manner to provide communication between the liquid sealing portion and the outside of said casing.

4. The fuel feed pump as set forth in claim 1, wherein:

a deairing groove is formed at least in the inner surface of said casing opposed to an upper surface of the impeller in such a manner that one end thereof is in communication with the upper space of the groove path and the other end thereof is in communication with said deairing holes, traversing the liquid sealing portion.

5. A fuel feed pump, comprising:

a casing immersed in a fuel tank of a motor vehicle, the casing including a pump head and a pump plate;

an impeller rotatable mounted in said casing, said impeller including a plurality of grooves provided on an outer periphery thereof;

an intake port formed in said pump head, said intake port impeller;

a discharge port formed in said pump plate, said discharge port being positioned communicating with said outer periphery of said impeller;

a liquid sealing portion positioned adjacent to said outer periphery of said impeller between said intake port and said discharge port;

a groove path formed between said intake port and said discharge port opposite said sealing portion;

a deairing hole formed in said pump head providing communication between said groove path and the exterior of said casing; and exhaust port means including an exhaust port space formed in said casing having a length substantially equal to a thickness of said impeller, said exhaust port space opening into an intermediate portion of said liquid sealing portion for providing communication between a side of said liquid sealing portion adjacent said periphery of said impeller and an exterior of said casing to environmental pressure whereby said exhaust port space is at a pressure level less than a discharge pressure at said discharge port.

* * * * *

UNITED STATES PATENT AND TRADEMARK OFFICE

CERTIFICATE OF CORRECTION

PATENT NO. : 5,192,184

DATED : March 9, 1993

INVENTOR(S) : Yamada et al

It is certified that error appears in the above-identified patent and that said Letters Patent is hereby corrected as shown below:

On the title page: Item

[75] Inventors: Nobuo Yamada, Kiryu; Keiji Kiuchi, Yabuzuka-honmachi, both of Japan Signed and Sealed this Sixteenth Day of November, 1993

*Attest:*

Bruce Lehman

BRUCE LEHMAN

*Attesting Officer*

*Commissioner of Patents and Trademarks*